US012767414B1

(12) United States Patent
Coglitore

(10) Patent No.: US 12,767,414 B1
(45) Date of Patent: Oct. 20, 2026

(54) DEVICE AND METHOD FOR PRESERVING WINE IN AN OPEN BOTTLE

(71) Applicant: Anthony Coglitore, Monroe Township, NJ (US)

(72) Inventor: Anthony Coglitore, Monroe Township, NJ (US)

( * ) Notice: Subject to any disclaimer, the term of this patent is extended or adjusted under 35 U.S.C. 154(b) by 0 days.

(21) Appl. No.: 19/406,657

(22) Filed: Dec. 2, 2025

(51) Int. Cl.
*B65D 81/24* (2006.01)

(52) U.S. Cl.
CPC ..... *B65D 81/245* (2013.01)

(58) Field of Classification Search
CPC ..... B65D 81/245
USPC ..... 220/216, 578, 579
See application file for complete search history.

(56) References Cited

U.S. PATENT DOCUMENTS 4,874,108 A * 10/1989 Valasek ..... B44D 3/12 220/578
8,662,342 B1 * 3/2014 DeTolla ..... B65D 81/245 220/803
2003/0102311 A1 * 6/2003 Brady ..... B65D 81/245 215/231
2007/0194057 A1 8/2007 Gehl
2008/0110847 A1 * 5/2008 Rees ..... B65D 81/245 215/264
2008/0170963 A1 7/2008 Cantrell

* cited by examiner

*Primary Examiner* — James N Smalley
(74) *Attorney, Agent, or Firm* — LaMorte & Associates, P.C.

(57) ABSTRACT

A device and method for preserving wine left in a bottle. An air impervious insert is provided that is capable of floating on the wine within the bottle. The air impervious insert is circular and has a diameter equal to said interior diameter of the wine bottle body plus/minus ten percent. The air impervious insert is biased into a flat configuration, but can be selectively manipulated into a rolled configuration. The air impervious insert is manipulated and inserted through the neck of the bottle. The air impervious insert automatically reverts back into its flat configuration once inside the body of the bottle. The air impervious insert floats atop the wine inside the bottle, therein creating a barrier between the wine and the headspace within the bottle. This inhibits the wine from reacting with the oxygen in the air of the headspace, therein preserving the quality of the wine.

5 Claims, 7 Drawing Sheets

DEVICE AND METHOD FOR PRESERVING WINE IN AN OPEN BOTTLE

BACKGROUND OF THE INVENTION

1. Field of the Invention

In general, the present invention relates to devices and methods that isolate a fluid in a container to prevent the fluid from oxidizing with the air in the headspace of the container. More specifically, the present invention relates to devices and methods that are used to prevent the oxidation of wine within an open bottle of wine.

2. Prior Art Description

It is well known that once a bottle of wine is open, air enters the headspace of the bottle. The air cannot be readily removed and remains within the bottle. As more wine is poured from the bottle, more air enters the bottle. The wine in the bottle reacts with the oxygen present within the headspace of the bottle. The wine slowly oxidizes causing the flavor notes of the wine to change. The oxidation of the wine typically causes the wine to first lose flavor, become flat, and to eventually sour.

If a bottle of wine is not emptied after being opened, the bottle of wine is typically recorked to prevent spillage and to prevent air from entering the bottle. However, even after the bottle is recorked, the wine bottle is partially filled with trapped air. If a 750 ml wine bottle is half full, it contains 375 milliliters of wine and 375 milliliters of air. That equates to approximately 80 milliliters of oxygen, which is more than enough to oxidize and alter the taste of the remaining 375 ml of wine.

In an attempt to preserve the flavor of wine, devices have been created that isolate the wine from the oxygen within the ambient air. For example, U.S. Patent Application Publication No. 2007/0194057 to Gehl and U.S. Patent Application Publication No. 2008/0170963 to Cantrell both disclose containers that isolate the liquid in the container from the surrounding air. However, when used in conjunction with a bottle of wine, the wine must be poured out of its bottle and into the specialized container. The pouring of the wine from bottle to container aerates the wine, therein causing more oxidation than would have occurred if the wine were simply left in its bottle. Furthermore, using a secondary container in addition to a bottle of wine is inconvenient, especially at times like a large dinner gathering when more than one bottle of wine is open at the same time.

A need therefore exists for a device and method that can isolate wine from air within the original bottle of wine without having to transfer the wine out of the bottle. A need also exists for a device that is simple and inexpensive to use and can isolate wine from air in a bottle. These needs are met by the present invention as described and claimed below.

SUMMARY OF THE INVENTION

The present invention is a device and method for preserving wine left in an open bottle of wine. The bottle of wine has a body with a first interior diameter that is accessible through a neck. The bottle of wine is open and holds both a volume of wine and a headspace of air. The air reacts with the wine and will spoil the wine over time.

To help preserve the wine, an air impervious insert is provided that is capable of floating on the wine within the bottle. The air impervious insert is circular and has a diameter equal to said interior diameter of the wine bottle body plus/minus ten percent. The air impervious insert is biased into a flat configuration, but can be selectively manipulated into a rolled configuration.

The air impervious insert is manipulated into a rolled configuration that is small enough to pass through the neck of the bottle. The air impervious insert is forwarded into the body of the bottle through the neck. The air impervious insert automatically reverts back into its flat configuration once inside the body of the bottle. The air impervious insert floats atop the wine inside the bottle, therein creating a barrier between the wine and the headspace within the bottle. This inhibits the wine from reacting with the oxygen in the air of the headspace, therein preserving the quality of the wine.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention wine preservation device can be embodied in many ways, only a few embodiments are illustrated and described. The exemplary embodiments are selected in order to set forth some of the best modes contemplated for the invention. The illustrated embodiments, however, are merely exemplary and should not be considered as limitations when interpreting the scope of the appended claims.

Figure 1:
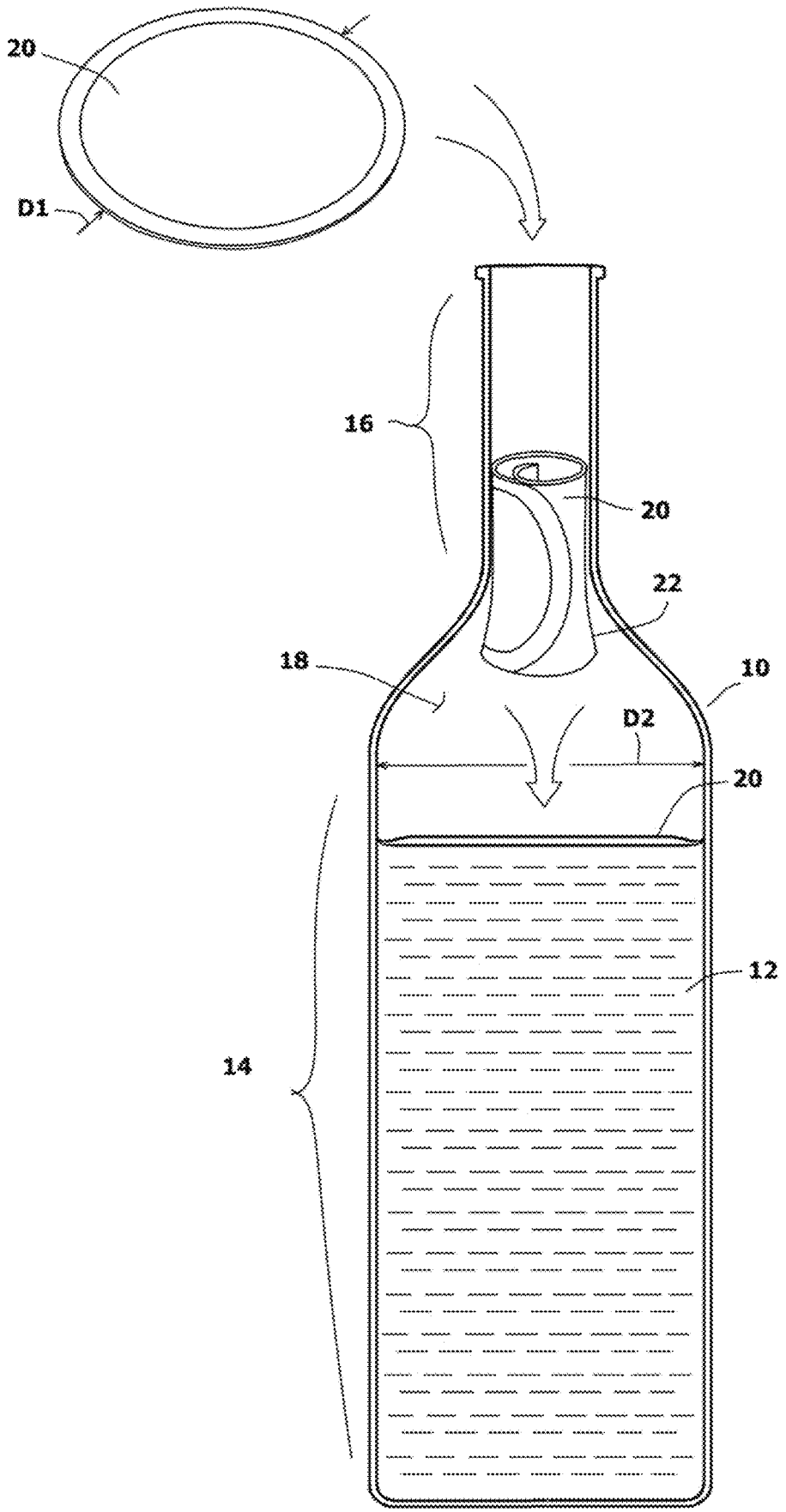
FIG. 1 shows an exemplary embodiment of the present invention shown in conjunction with a bottle of wine.

Referring to FIG. 1, a typical modern bottle 10 of wine 12 is shown that contains 750 milliliters of wine 12 when full. Such a bottle 10 is typically between 29 cm and 33 cm tall and has a width of between 7 cm and 9 cm depending upon the contents and source. The bottle 10 of wine 12 has a main body 14 that is accessible through a narrowed neck 16. The inner diameter of the neck 16 is typically between 21 mm and 26 mm to accommodate a cork.

A full bottle 10 of wine 12 serves approximately five to six glasses of wine 12, depending upon pour volume. If two glasses of wine 12 are consumed, this leaves at least three servings of wine 12 in the bottle 10 for consumption at another time. It also allows air to enter the headspace 18 of the bottle 10.

In FIG. 1, an air impervious insert 20 is shown at three stages of use. The air impervious insert 20 is shown outside the bottle 10, in the neck 16 of the bottle 10 and floating atop the wine 12 in the body 14 of the bottle 10. The air impervious insert 20, when in a flat configuration, is circular and has a diameter D1 that is equal to the interior diameter D2 of the bottle 10 plus/minus five percent. The air impervious insert 20 is biased into its flat configuration. The air impervious insert 20 has three essential characteristics. First, the air impervious insert 20 must be flexible enough to be manually manipulated out of its flat configuration and into a roll 22 that is small enough to insert through the neck 16 of the bottle 10. Wine bottles utilize corks that have a diameter of between 21 mm and 26 mm. Accordingly, the air impervious insert 20 must be able to be manipulated into a roll 22 that is no larger than the cork so that the roll 22 can enter the bottle 10 through the neck 16 of the bottle 10. Second, the air impervious insert 20 must be stiff and/or resilient enough to be biased into its unrolled flat configuration when external forces are removed. Accordingly, once the roll 22 is inserted into the main body 14 of the bottle 10 through the neck 16 of the bottle 10, the roll 22 automatically opens inside the bottle 10. Third, the air impervious insert 10 must be made from materials that are impervious to air and are not reactive with wine 12 or its chemical components.

Depending upon the sugar content, the wine 12 typically has a specific gravity of between 0.990 g/cm3 and 1.020 g/cm3. The air impervious insert 20 has an average specific gravity that is less than 0.990 g/cm3. As a result, the air impervious insert 20 floats upon the wine 12 inside the bottle 10. The air impervious insert 20 therein acts as a physical barrier on the surface of the wine 12 that separates the wine 12 from the air in the headspace 18 of the bottle 10.

Figure 2:
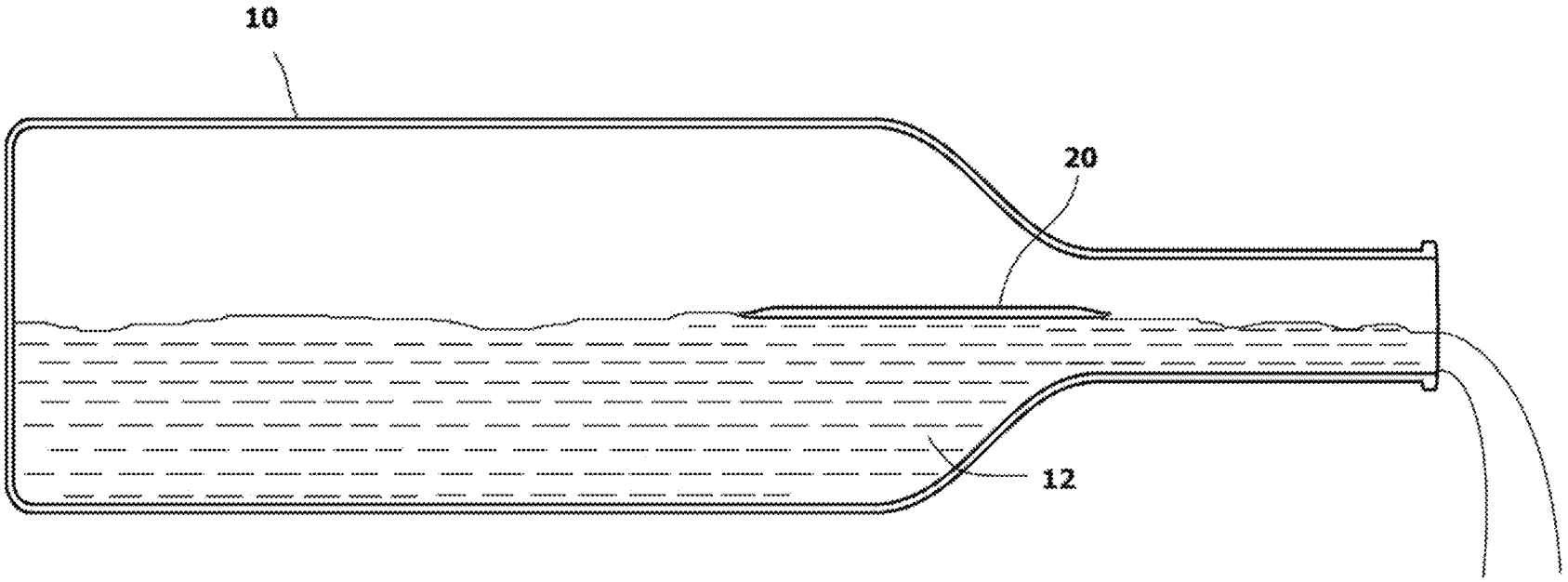
FIG. 2 shows the exemplary embodiment of FIG. 1 shown inside a bottle of wine as the wine is being poured.

Referring to FIG. 2 in conjunction with FIG. 1, it can be seen that when the bottle 10 of wine 12 is poured, the air impervious insert 20 remains afloat atop the wine 12. In this manner, the wine 12 is free to flow out of the neck 16 of the bottle 10 without being inhibited by the presence of the floating air impervious insert 20. Once the bottle 10 of wine 12 is empty, the air impervious insert 20 can be removed or the bottle 10 of wine 12 can be disposed of with the air impervious insert 20 still inside the bottle 10.

Figure 4:
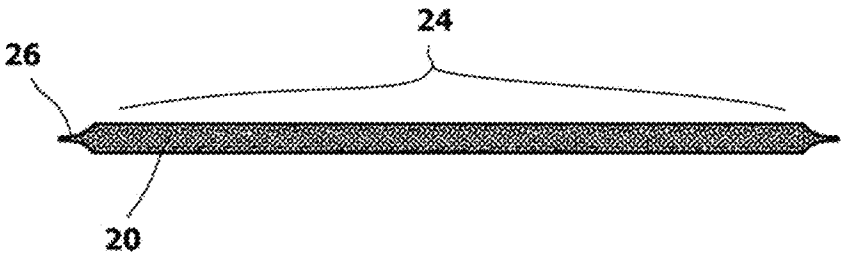
FIG. 4 is a side cross-sectional view of the air impervious insert of FIG. 3.
Figure 3:
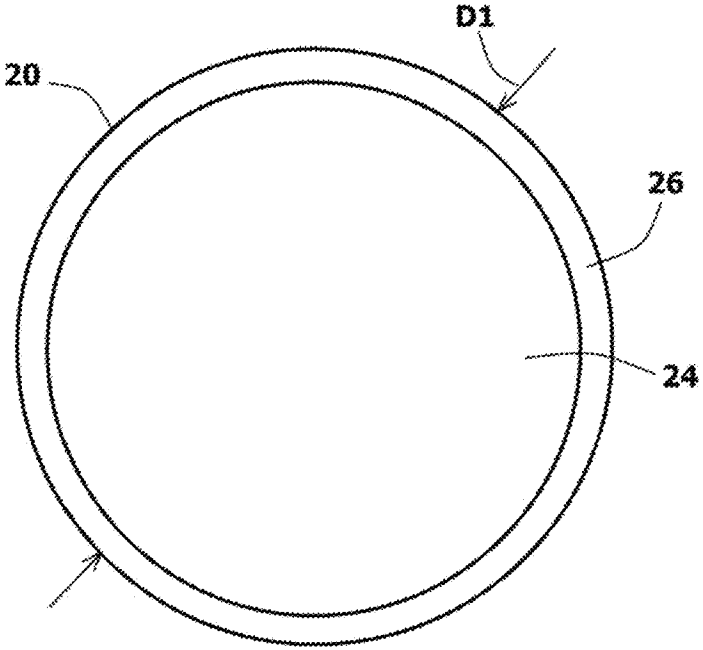
FIG. 3 shows a top view of the exemplary embodiment of an air impervious insert used in the exemplary embodiment.

The floating air impervious insert 20 can be made in multiple ways. In all embodiments, the per-unit cost of the floating air impervious insert 20 is preferably less than $0.25 so as to be an economical one-time-use product. Referring to FIG. 3 and FIG. 4, a first embodiment of the floating air impervious insert 20 is shown. The floating air impervious insert 20 is made from a food-safe plastic such as polyethylene terephthalate, high-density polyethylene, low-density polyethylene, and polypropylene. Some of these plastics have a specific gravity higher than that of wine. For example, the specific gravity of polyethylene terephthalate is typically around 1.38 g/cm$^3$. This could cause the air impervious insert 20 to sink. Accordingly, if a plastic is being utilized that will not naturally float on wine, then the air impervious insert 20 can be made into a closed cell plastic foam to decrease the density of the plastic. In the shown embodiment, the air impervious insert 20 has a central area 24 made of closed-cell foam. The central area 24 is surrounded by a peripheral ring 26 where the plastic foam is compressed and heat bonded into a solid. This stiffens the peripheral ring 26. The stiffened peripheral ring 26 assists the air impervious insert 20 in retaining its original shape and returning to a flat circular shape after being rolled. The central area 24 can be as thick as a few millimeters. The peripheral ring 26 can taper to a minimal thickness of less than 0.25 mm.

Figure 5:
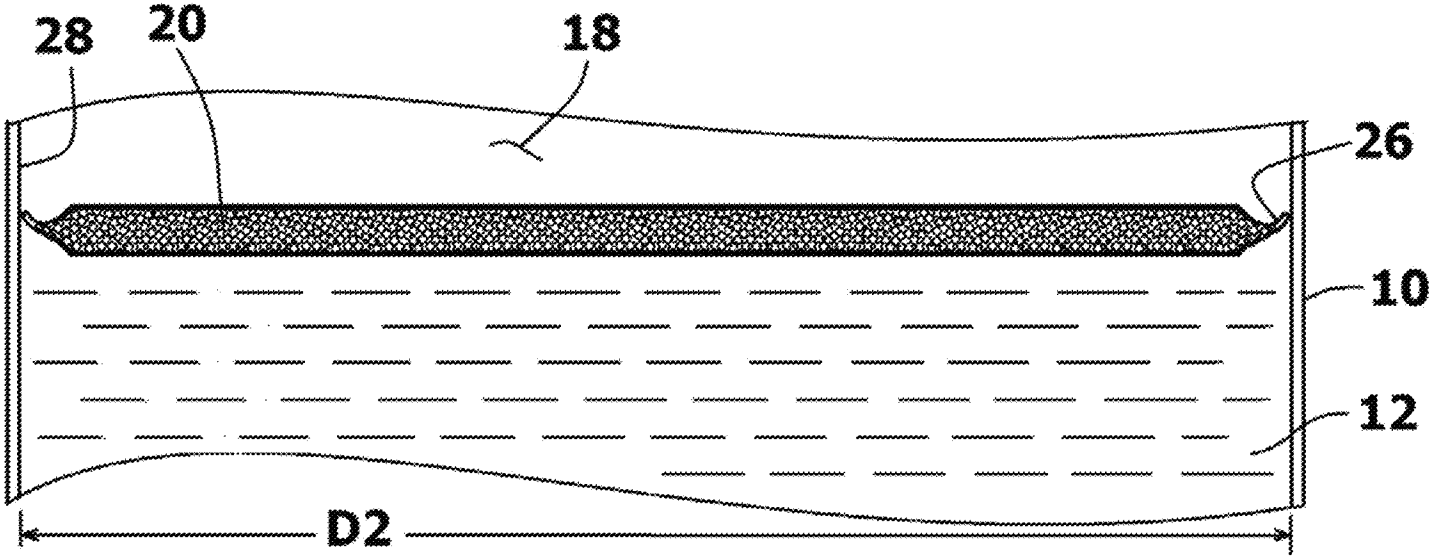
FIG. 5 is an enlarged view of the air impervious insert of FIG. 4 shown inside a bottle of wine.

Referring to FIG. 5 in conjunction with FIG. 4 and FIG. 3, it can be seen that the diameter D1 of the peripheral ring 26 can be slightly larger than the interior diameter D2 of the wine bottle 10. In this manner, the thin peripheral ring 26 can curve up onto the interior wall 28 of the bottle 10 as the air impervious insert 20 floats on the wine 12. This separates the wine 12 from the air in the headspace 18 of the bottle 10, therein inhibiting the oxidation of the wine 12.

Figure 7:
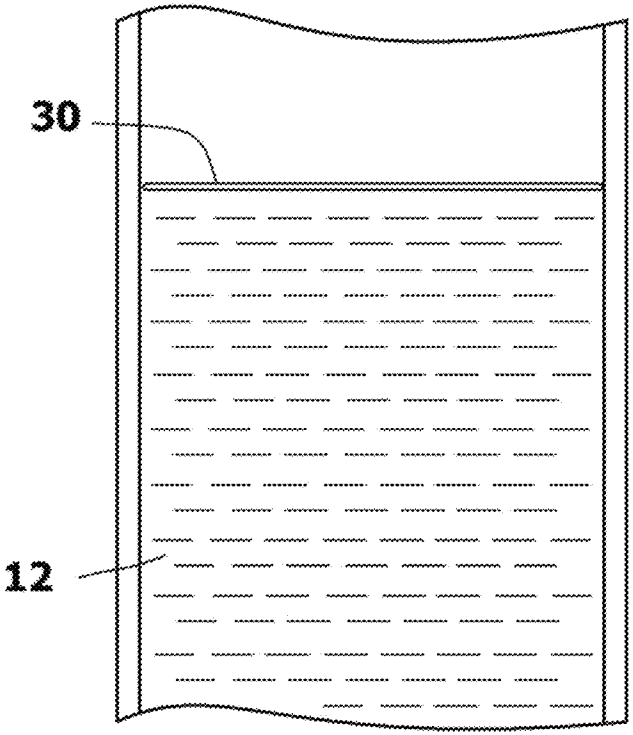
FIG. 7 shows a side cross-sectional view of an alternate embodiment of an air impervious insert.
Figure 6:
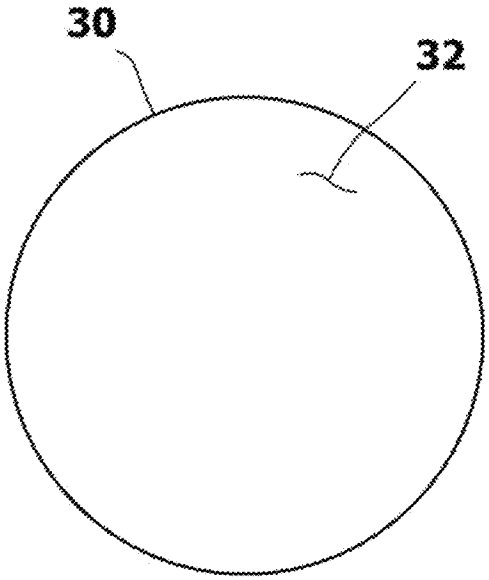
FIG. 6 shows a top view of an alternate embodiment of an air impervious insert.

Referring to FIG. 6 and FIG. 7, an alternate embodiment of the air impervious insert 30 is shown. In this embodiment, the air impervious insert 30 is made from a simple layer of plastic 32 that has a specific gravity less than that of wine 12. For example, the air impervious insert 30 can be made from low-density polyethylene which has a specific gravity of between 0.910 g/cm$^3$ and 0.940 g/cm$^3$. The air impervious insert 30 can have any thickness provided the air impervious insert 30 is thin enough to be rolled into a shape that can fit through the neck 16 of the bottle 10, and is thick enough to automatically unwind and flatten once inside the bottle 10.

Figure 9:
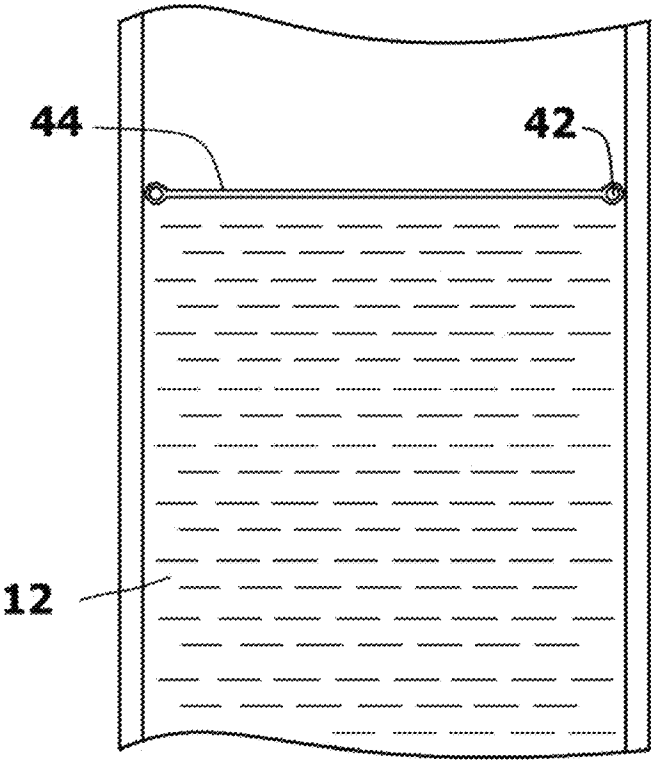
FIG. 9 is a view of the air impervious insert of FIG. 8 inserted inside a bottle of wine.
Figure 8:
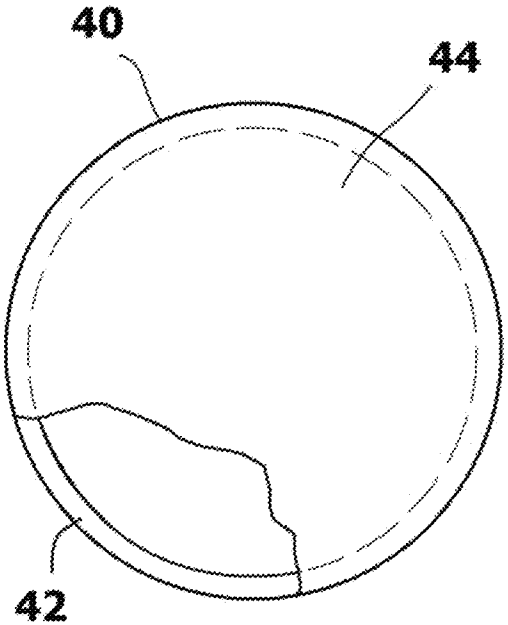
FIG. 8 shows a top view of an alternate embodiment of an air impervious insert.

Referring to FIG. 8 and FIG. 9, another alternate embodiment of an air impervious insert 40 is shown. In this embodiment, a plastic O-ring 42 is provided that is made from a food safe elastomeric material. The O-ring 42 is bonded to a thin circular sheet of cover material 44. The cover material 44 can be plastic, but coated paper, such as wax paper, can also be used. The overall weight of the air impervious insert 40 is made light enough to float on wine 12.

The O-ring 42 can be rolled or otherwise deformed into a shape that is small enough to pass through the neck 16 of a bottle 10. Once inside the bottle 10, the O-ring 42 automatically returns to its original ring shape, therein expanding the cover material 44 over the wine 12 inside the bottle 10.

Figure 10:
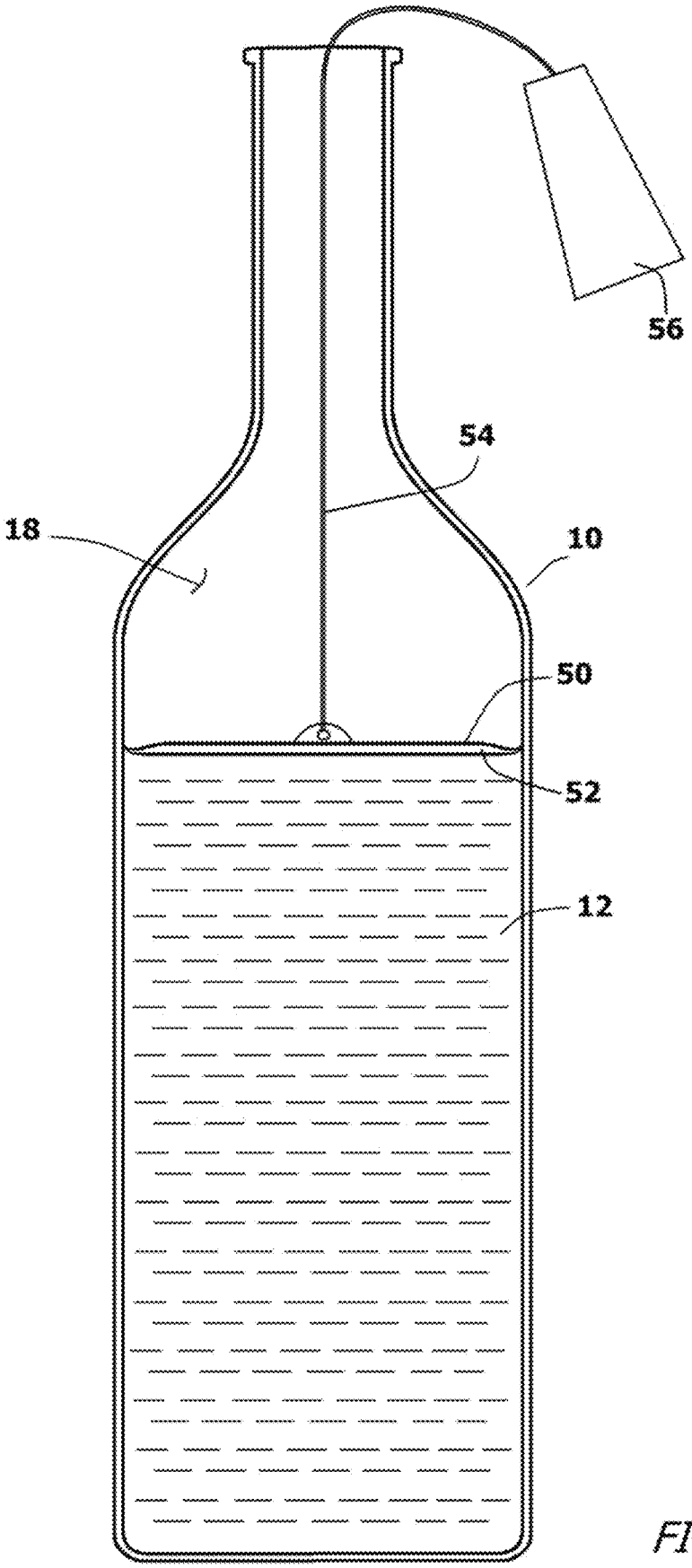
FIG. 10 shows a wine protection system with an air impervious insert tethered to a cap device.

Referring to FIG. 10, a wine protections system 50 is disclosed that includes an air impervious insert 52. The air impervious insert 52 can be any of the air impervious inserts previously described. A tether 54 is provided that connects the air impervious insert 52 to a cap device 56. The cap device 56 can be a cork, a threaded cap, or a bottle stopper. The air impervious insert 52 is rolled and inserted into the bottle 10. The air impervious insert 52 covers the wine 12 and prevents the wine 12 from reacting with the oxygen in the headspace 18 of the bottle 12. The cap device 56 closes the neck 16 of the bottle 10 and prevents spillage. The cap device 56 also isolates the air in the headspace and prevents that air from receiving any further oxygen. Once all the wine 12 is poured from the bottle 10, the cap device 56 can be removed. The cap device 56 is connected to the bottle 10 insert via the tether 54. As a result, the cap device 56 can be pulled with enough force to deform the air impervious insert 52 into and through the neck 16 of the bottle 10. Once removed from the bottle 10, the components of the wine protection system 50 can be washed and reused on another bottle.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. In a bottle of wine having a body with a first interior diameter that is accessible through a neck, wherein said bottle of wine holds both a volume of wine and a headspace of air, a method of inhibiting said volume of wine from reacting with oxygen in said headspace of air, comprising:

providing an air impervious insert capable of floating on said volume of wine, said air impervious insert being a circular segment of a closed-cell plastic foam having a central section surrounded by a peripheral section, wherein said closed-cell plastic foam is compressed and heat bonded into a solid only within said peripheral section creating a stiffened peripheral ring around said central section, wherein said air impervious insert has a diameter equal to said first interior diameter of said body plus/minus ten percent, and wherein said air impervious insert is biased into a flat configuration in part by said stiffened peripheral ring, temporarily rolling said air impervious insert into a rolled configuration that is small enough to pass through said neck of said bottle; and inserting said air impervious insert into said body of said bottle through said neck of said bottle, wherein said air impervious insert automatically returns into said flat configuration once in said body, and wherein said air impervious insert floats atop said wine in said bottle, therein creating a barrier between said wine and said headspace within said bottle.

2. The method according to claim 1, wherein providing said air impervious insert includes providing said air impervious insert that is made from a said closed-cell plastic foam having a specific gravity lower than that of said wine in said bottle.

3. The method according to claim 1, wherein said closed-cell plastic foam material selected from a group comprising polyethylene terephthalate, high-density polyethylene, low-density polyethylene, and polypropylene.

4. The method according to claim 1, further including connecting said air impervious insert to a tether and removing said air impervious insert from said bottle by pulling said air impervious insert out of said bottle with said tether.

5. The method according to claim 1, wherein said central section has a first thickness and said peripheral ring is thinner than said central section.

* * * * *